United States Patent [19]

Lakic

[11] Patent Number: 4,823,482

[45] **Date of Patent: * Apr. 25, 1989**

[54] INNER SHOE WITH HEAT ENGINE FOR BOOT OR SHOE

[76] Inventor: Nikola Lakic, 73-355 Guadalupe Ave. Unit M, Palm Desert, Calif. 92260

[ * ] Notice: The portion of the term of this patent subsequent to Apr. 12, 2005 has been disclaimed.

[21] Appl. No.: 93,579

[22] Filed: Sep. 4, 1987

[51] Int. Cl.[4] ..... A43B 7/02; A43B 5/04; F28F 7/00

[52] U.S. Cl. ..... 36/2.6; 36/119; 128/382; 165/46

[58] Field of Search ..... 36/26, 27, 28, 117, 36/119, 3 R, 10; 219/211, 527; 128/382, 383; 165/46; 2/1

[56] References Cited

U.S. PATENT DOCUMENTS

| | | | |
|---|---|---|---|
| 3,663,796 | 5/1972 | Hines et al. | 36/2.6 X |
| 4,154,009 | 5/1979 | Kubelka et al. | 36/119 |
| 4,507,877 | 2/1985 | Yaccari et al. | 36/2.6 |
| 4,615,127 | 10/1986 | Delery | 36/117 |
| 4,665,308 | 5/1987 | Courvoisier et al. | 36/2.6 X |
| 4,697,359 | 10/1987 | Balbinot | 36/2.6 |
| 4,702,022 | 10/1987 | Porcher | 36/119 |
| 4,730,403 | 3/1988 | Walkhoff | 36/119 |
| 4,736,530 | 4/1988 | Lakic et al. | 36/2.6 |

FOREIGN PATENT DOCUMENTS

| | | | |
|---|---|---|---|
| 2321817 | 11/1973 | Fed. Rep. of Germany | 36/3 R |
| 1223883 | 4/1986 | U.S.S.R. | 36/2.6 |
| 2107853 | 5/1983 | United Kingdom | 2/1 |

*Primary Examiner*—James Kee Chi

*Attorney, Agent, or Firm*—Plante Strauss Vanderburgh

[57] ABSTRACT

There is disclosed an inner shoe for a boot such as a ski boot which includes a foot warmer mechanism having a heat engine which includes a compressor, evaporator and condenser coils and interconnecting conduits for circulating a working refrigeration fluid. In a preferred embodiment, the cycle of the heat engine can be reversed, thereby cooling the inner shoe. The mechanism also includes an entirely sealed, remote latch to lock the heat engine out of operation. The inner shoe can have an air system that includes an air bag which surrounds its instep area and communicates to a sealed chamber between the soles of the shoe. The air bag can be pressured to maintain a sense of tightness or security to the ski boot. The air system also augments heat transfer within the boot.

25 Claims, 11 Drawing Sheets

INNER SHOE WITH HEAT ENGINE FOR BOOT OR SHOE

BACKGROUND OF THE INVENTION

1. The Field of the Invention

This invention relates to a warming device for shoes and boots, and in particular to a simple device for generating heat within a shoe or boot.

2. Brief Statement of the Prior Art

U.S. Pat. No. 3,534,391 discloses an electrical generator which is mounted on the outside of a ski boot which is driven from a tether that is connected between the generator and a ski. The generated current is passed through heating elements located in the ski boot. The external mounting and tether render this device quite cumbersome and difficult to use.

French Patent Nos. 701,420 and 2,365,973 and U.S. Pat. No. 3,977,093 disclose shoes with batteries mounted in the heels, and with electric resistance heaters in the soles of the shoes. Batteries require frequent replacement, and are particularly inefficient in a cold environment.

U.S. Pat. No. 1,506,282 discloses an electric generator mounted in an telescoping heel of a shoe which generates electricity for an electric lamp, heating coil, wireless outfit or a therapeutic appliance. A telescoping heel of this design would be very difficult to seal against water and mud, and the patented device would most likely be limited to indoor applications.

U.S. Pat. Nos. 2,442,026 and 1,272,931 disclose air pumps which are located in the heels of shoes and operated during walking. In the first mentioned patent, alcohol vapors are mixed with the air stream and passed over a catalyst to generate heat. This system is cumbersome and difficult to use, and it requires replenishing the alcohol. Also, the heater elements are open in the shoe for air and gas circulation. In U.S. Pat. No. 1,272,931, the air is forced through constricted passageways to generate heat by compression. The heated air is openly discharged into the shoe, as there is no provision for a closed loop air path.

U.S. Pat. No. 382,681 discloses an armature which is mounted in a heel and manually rotated to generate heat by friction, which is dissipated in the shoe by metal conductors. U.S. Pat. No. 3,493,986 discloses an inner sole for a shoe which is formed of piezoelectric or magnetostrictive material which generate heat while the user walks.

U.S. Pat. No. 2,475,092 discloses a bouncing skate having spring coils on the bottom of its sole. German Patent Nos. 180866 and 620,963, and U.K. Patent No. 443,571 disclose springs mounted within a shoe for orthopedic purposes. None of these patents disclose shoe heaters.

U.S. Pat. No. 4,507,877 discloses a heater for a ski boot which is mounted on the inner shoe of the boot and which includes rechargeable storage batteries, control switch and electrical heating coil. Products of this design have been marketed with chargeable and with nonrechargeable batteries. These units do not provide any sustained heating, but are useful only to provide monetary heating because of the limited storage capacity of small batteries and the low efficiencies which they experience at sub-freezing temperatures.

All of the aforementioned attempts have failed to provide a practical self sustaining heater within a shoe which harnesses the movement between the wearer's heel and the heel of the shoe to generate heat. This relative movement can be sufficient, particularly when the wearer's weight is applied, to generate the necessary heat, provided a practical heat generator can be installed within the narrow confines of the shoe and heel, without significantly affecting its external appearance and comfort.

Air bags have been positioned in ski boots, over the instep and forefoot, and have been provided with inflation pumps to provide a variable control on the snugness of fit of the boots. U.S. Pat. No. 4,420,893 discloses an air pump which is operated by the flexing of the ankle during normal skiing actions to circulate fresh air through a ski boot. While this may be useful to reduce the humidity within a boot, it would not be suitable in very cold weather.

BRIEF DESCRIPTION OF THE INVENTION

This invention comprises a foot warmer mechanism for a shoe, particularly for a ski boot. The foot warmer mechanism is mounted entirely on an insert for the outer boot or shoe, and includes an a heat engine and, in particular, a heat engine operating on a substantially- or quasi-Carnot cycle. For this purpose, the warming mechanism includes a compressor for compressing a gas, a condenser for condensing the gas into a liquid, an expansion and evaporator zone for expanding the liquified gas into a gas and a return line to cycle the expanded gas to the compressor.

BRIEF DESCRIPTION OF THE DRAWINGS

The invention will be described with reference to the FIGURES, of which.

DESCRIPTION OF PREFERRED EMBODIMENT

Figure 1:
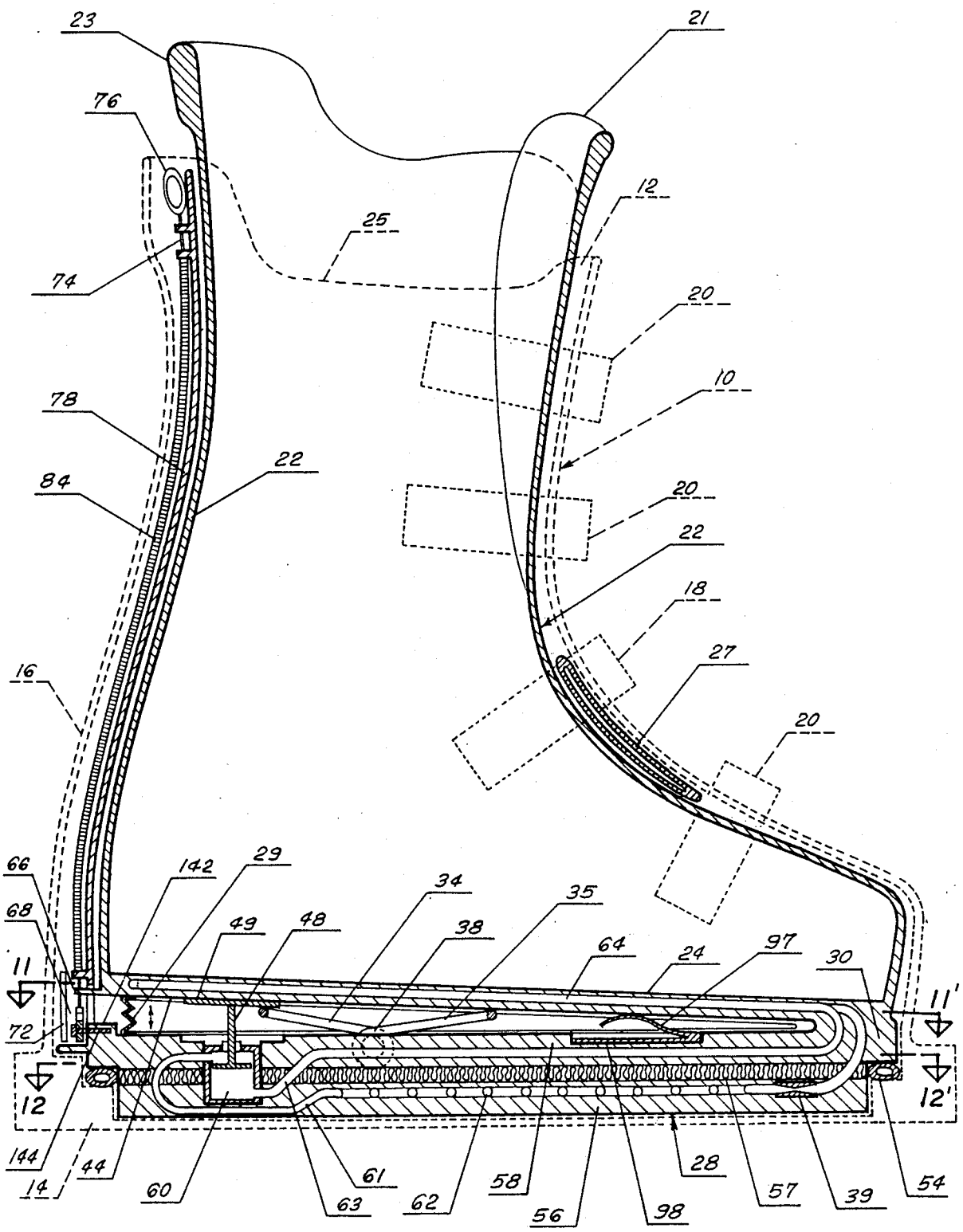
FIG. 1 is an elevational sectional view of a ski boot fitted with the foot warmer invention.

Referring now to FIG. 1, the invention is shown as applied to the inner shoe of an outwardly appearing, conventional ski boot 10. Although the invention is shown as applied to a ski boot, it could also be applied to any conventional boot or shoe of similar construction. The ski boot 10 is shown in phantom lines and comprises a molded plastic shell 12 with a molded outer sole 14 and a plastic molded upper portion 16. The upper portion 16 can be spread or opened to permit moving the boots on and off the wearer's foot and has a plurality of fastening buckles 18 and 20 to secure the upper portion 16 in a snug conforming fit about the wearer's ankle and foot. Some of the fastener buckles, particularly buckles 18 which are over the instep are provided with adjustment for controlled variation of their tension, thereby providing control over the relative degree of movement of the foot within the boot 10. Alternative and conventional tension adjustments could be used, e.g., cables can be extended over the instep and provided with tensioning adjustments.

In the conventional outer ski boot 10, the outer sole 14 is hollow form with reinforcing ribbing (not shown) which extends longitudinally and transversely across the outer sole 14, subdividing its hollow interior into a number of recesses or compartments. In the application of my invention to this boot, this ribbing is reduced in height, or eliminated entirely, to provide an open hollow interior to house the foot warmer mechanism.

The inner shoe 22 for the ski boot 10 is shown in elevational cross sectional view and comprises a snug fitting sock having an upper neck 23 which extends above the upper edge 25 of the upper portion of the ski boot 10, an integral tongue 21, and an integral lower sole 28. The inner shoe also supports an air bag 27 which surrounds the upper instep of the shoe and which is contained within the boot 10.

The foot warmer of the invention is applied to the inner shoe 22 by molding a lower sole 28 of several layers. The lowermost layer 56 is separated from the upper layer 58 of the lower sole 28 of the inner shoe 22 by a thin layer 57 of thermal insulation. The space between the lower sole 28 and inner sole 24 is sealed by a membrane 29 which is formed into a bellows configuration. The interior of the boot is thus provided with two air chambers, that contained within the air bag 27, and that contained between the inner sole 24 and lower sole 28. These air chambers are contiguous, i.e., in open communication, in the manner described hereinafter.

Some of the components of the heat engine of the shoe are received within the lower sole 28, and can be molded within this sole during its manufacture, or can be housed within hollow compartments which are molded in the lower sole 28, which is received within the hollow interior of the outer sole 14 of the ski boot 10.

The heat engine components which are located in the lower sole 28 are the compressor 60 and the evaporator coil 62, with appropriate connecting tubing such as 61 for transferring the expanded and evaporated gas from evaporator coil 62 to the compressor 60, and tubing 63 for transferring the compressed gas from the compressor 60 to the condenser coil 64.

The inner shoe 22 also includes an inner sole 24 which is a stiff, or relatively non-flexible plate that is pivotally secured to the lower sole 28 of the inner shoe 22 at its toe end. Preferably the upper and lower soles are molded together of the same plastic, thereby providing an integral hinge 30 at the toe of the inner shoe 22. The inner sole 24 is resiliently biased upwardly by spring arms 34 and 35 which project rearwardly and forwardly, respectively, from coil spring 38. If desired, a pocket 98 can be formed in the upper layer 58 of the outer sole 28 and a leaf spring 97 can be placed in this compartment, to supplement the resilient action of spring 38.

The compressor 60 has an upright post 48 which extends from the internal piston of the compressor. At its upper end the post 48 has a bearing plate 49 which is received against the undersurface 44 of the inner sole 24. The post 48, as hereinafter described, is attached at its lower end to the piston of compressor 60, to translate reciprocating vertical motion to compression of the working fluid of the heat engine.

At the heel end, the inner sole 24 has a distal tab 66 which projects into a brake compartment 68 formed as a pocket behind the heel of the inner shoe 22. The lower sole 28 has a raised integral block 142 at its heel end, which receives a machine screw fastener 144 for pivotal attachment of the brake latch, described in greater detail with reference to FIGS. 13–16. The brake pocket 68 is covered by vertical plate 72. An actuator cable 74 extends from the brake compartment 68 to the upper portion of the inner shoe 22 and is provided with a suitable handle, ring 76, to actuate the brake of the mechanism. As hereinafter described, the brake is functional to provide a releasable locking of the inner sole 24 against vertical displacement, thereby providing for engagement and disengagement of the heat engine.

Figure 2:
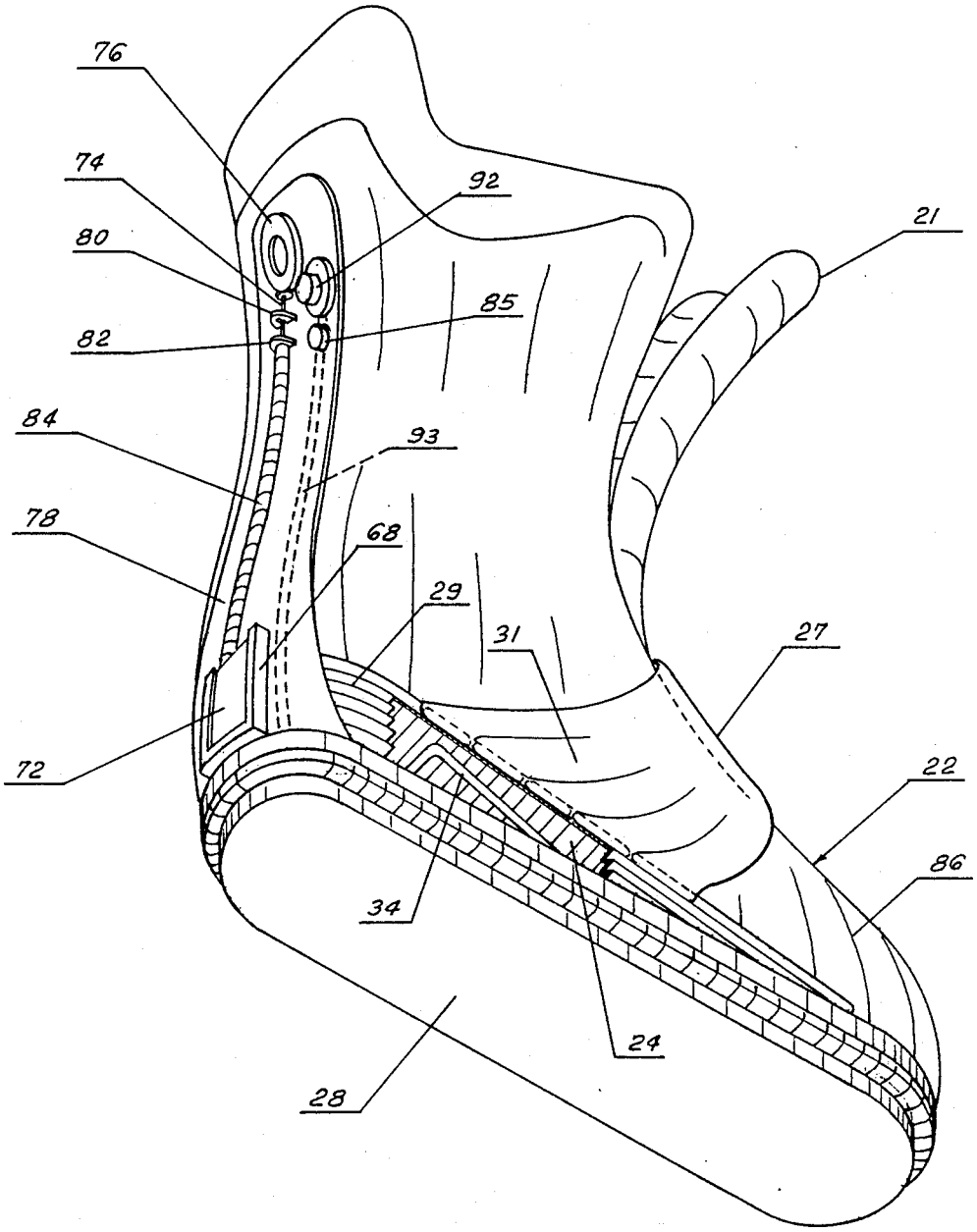
FIG. 2 is a perspective view of the inner shoe of the boot of FIG. 1.

Referring now to FIG. 2, the inner shoe is shown in a perspective view. A portion of the side of membrane 29 is cut away to permit viewing into the confined space between the inner sole 24 and lower sole 28. The inner shoe 22 is formed of a molded, compressible plastic foam which is integrally sealed to a stiff bottom plate which forms the inner sole 24. The lower sole 28 is integrally attached to the inner sole 24 at its toe end and is coextensive with the length and width of the inner sole 24. At its heel end, the lower sole 28 supports a stiff or rigid vertical tab 78 that is formed as an integral molding of the lower sole 28. The tab 78 has brackets 80 and 82 at its upper end to receive the cable 74 which terminates in the pull ring 76 and which extends downwardly through a protective, flexible conduit 84 to the brake compartment 68. The lower sole 28 also distally supports the brake compartment 68 which is formed as an integrally molded pocket at its heel end with a removable vertical plate 72 that is slidably received in the pocket to protect the moveable elements of the brake to prevent interference with the inner surfaces of the outer boot 10 that would obstruct free movement of these elements. The bag 27 extends laterally across the instep of the inner shoe and communicates through the sidewall of membrane 29 by one or more channels 31, which are preferably sized adequately to avoid any significant resistance to air flow.

The interior of the inner shoe 22 can be formed with channels 86 about its surface, all as conventional for the construction of inner shoes of ski boots. The rearwardly projecting spring arm 34 which resilient urges the upper sole 24 and lower sole 28 apart also appears in FIG. 2.

Figure 3:
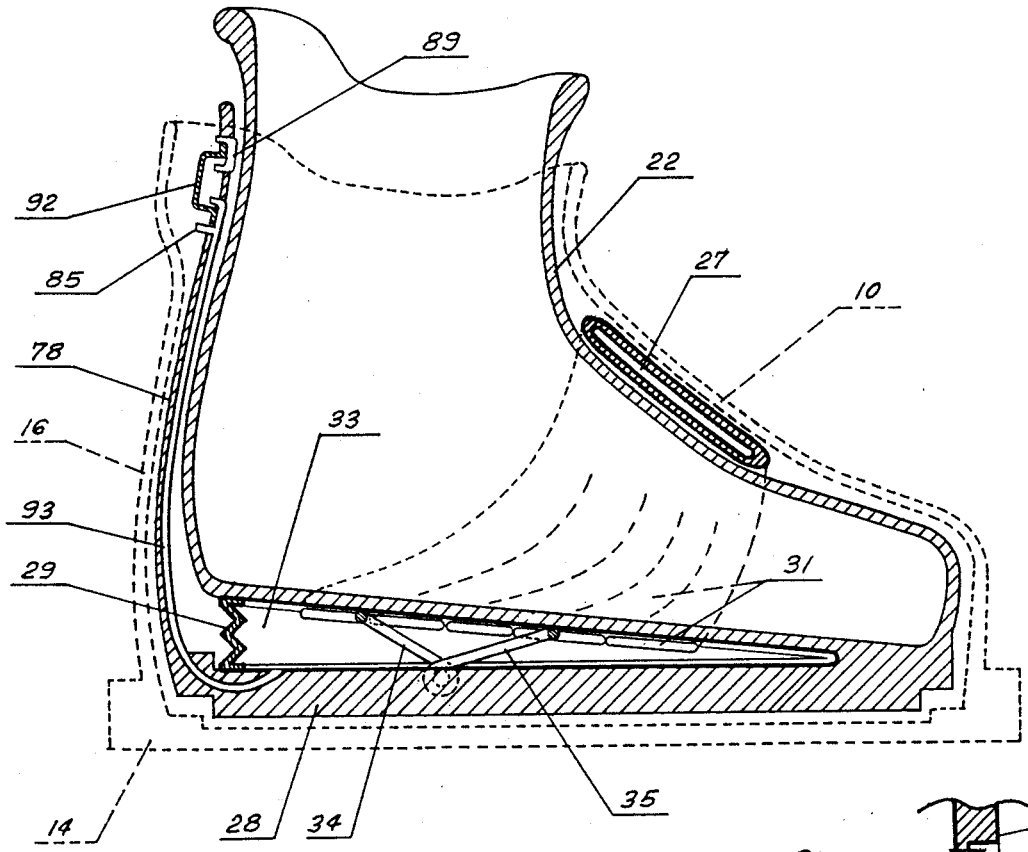
FIGS. 3 and 4 are elevational section views of the ski boot illustrating an air cushion between the inner shoe and boot.
Figure 4:
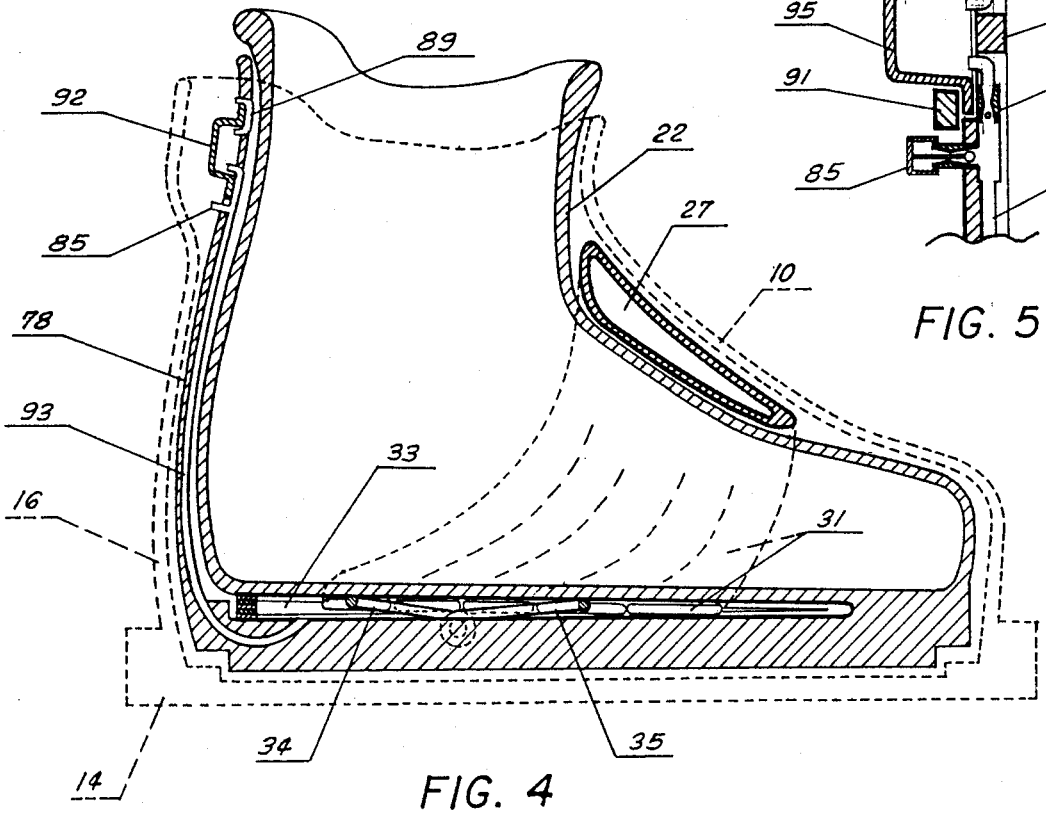

Referring now to FIGS. 3 and 4, the heat engine elements are not illustrated, to provide a simplified illustration of the function and operation of the air bag 27. Also, the air circulation system shown in these FIGS. 3 and 4, can be used without the heating means, for benefits of comfort and shock absorbency. As previously mentioned, the air bag 27 forms a confined chamber which is in open communication with the enclosed chamber, cavity 33, that is located between the inner sole 24 and lower sole 28. An air pump 92 is provided to permit the wearer to adjust the air pressure within the cavity 33 and air bag 27. The pump applies air though flexible conduit 93 into the cavity 33.

The air bag 27 functions to maintain a sense and feeling of tight lacing or binding of the ski boot, while permitting a limited freedom of movement of the inner shoe within the boot. In FIG. 3, the inner shoe is shown in its most elevated position, with the heel of the inner sole elevated above the lower sole 28. The air bag 27 is compressed in this position, exhausting its air into the cavity 33 which is confined by membrane 29. When the wearer's weight is applied to the heel, the heel of the inner sole 24 moves downwardly, forcing the air from cavity 33 into the air bag 27. Thus, although the instep of the inner shoe 22 moves away boot 10, the wearer still senses a tightness of fit, as the air bag 27 maintains pressure on the instep. The normal movement of the wearer's foot within the shoe will create a forced circulation of air through the cavity 33 which is heated (or cooled as described hereafter) by the coil 64 and into the air bag 27. This forced circulation increases the heat transfer throughout the shoe.

Figure 5:
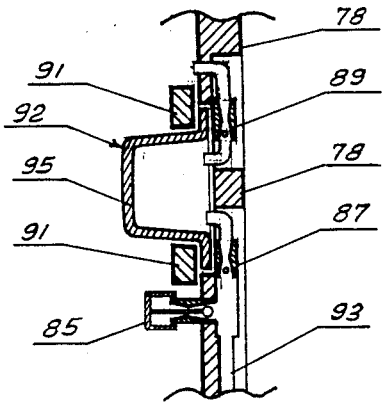
FIG. 5 is an enlarged sectional view of the air pump used with the boot of FIGS. 3 and 4.

Referring now to FIG. 5, the air pump 92 comprises a flexible bulb 95 which is sealed in the assembly by ring 91. The bulb 95 receives air through the inlet valve 89 and discharges the air under pressure through outlet valve 87. The air system is also provided with a relief valve 85, which when depressed will relieve the air pressure within the air bag system.

Figures 6, 7:
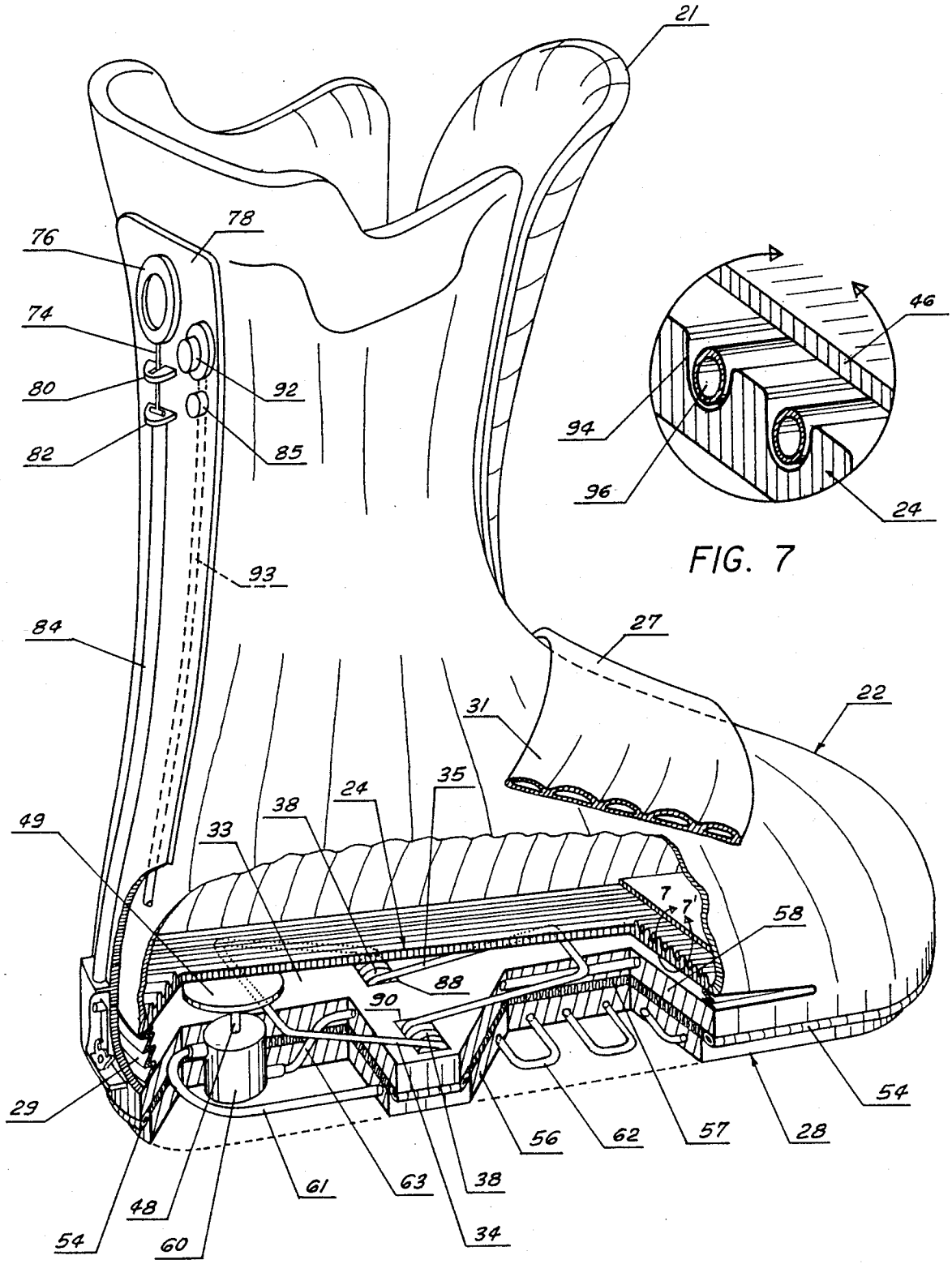
FIG. 6 is a perspective view of the inner shoe in partial cut away section.
FIG. 7 is an enlarged view of the area within the line 7—7' of FIG. 6.

Referring now to FIG. 6, the inner shoe of the ski boot is shown with a portion of the side of the inner shoe cut away to reveal its interior and the major components of the heat engine.

The inner sole 24 supports the condenser coil 64 of the heat engine and receives the compressed fluid from the compressor 60 through conduit 63. The lower layer 56 of the outer sole 28 receives the evaporator coil 62 of the heat engine which is in the form of a continuous serpentine coil that receives the depressed working fluid from an expansion valve or tube, described hereinafter. The lower layer is separated from the upper layer 58 by a layer of thermal insulation 57. Preferably, a peripheral seal 54 is positioned between the upper layer 58 and lower layer 56. The seal is formed of a resilient material, e.g., rubber or a flexible plastic. This seal 54 can be separately formed and secured to the peripheral edge of the inner shoe, or can be integrally molded with the inner shoe. The seal 54 projects slightly outside of the sole layers so that it will resiliently engage against the inside wall of the sole 14 of the ski boot, thereby restricting or preventing air flow between the upper and lower layers of the lower sole 28. The compressor 60 is mounted in the outer sole 28 with plate 49 mounted beneath the inner sole 24 at the heel of the inner shoe.

At the instep area, the upper layer 58 of the outer sole 28 has two pockets 88 and 90 which are laterally disposed and which receive the helical windings of the torsion springs 38 that provide the resilient upward bias to the U-shaped arms 34 and 35 that urge the inner sole 24 in an upward direction.

Figure 8:
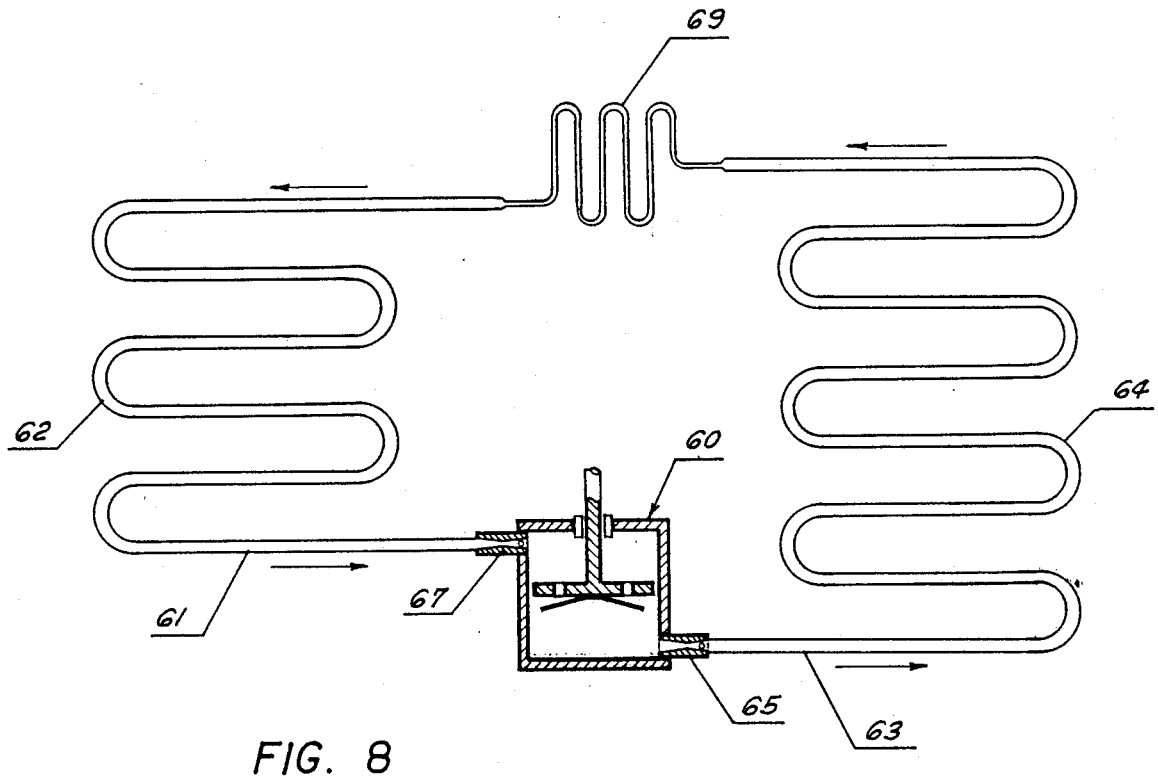
FIG. 8 is a diagrammatic view of the working elements of the heat engine used in the invention.

As shown in FIG. 7, the upper surface of the inner sole 24 has a plurality of parallel grooves 94 in which are received the tubes 96 which constitute the condenser coil 64 of the heat engine (see FIG. 8). The inner sole is preferably covered with a cushioning layer 46.

Referring now to FIG. 8, the heat engine of the invention will be briefly described. As there illustrated, the heat engine comprises a closed circulation system comprising compressor 60 with check valves 65 and 67. Tubing 63 discharges the compressed working fluid into the condenser coil 64, and the condensed fluid is discharged through the capillary coil 69. The capillary coil 69 discharges the expanded fluid into the evaporator coil 62. The expanded and evaporated gas from this coil is discharged by tubing 61 through valve 67 into compressor 60.

Figure 9:
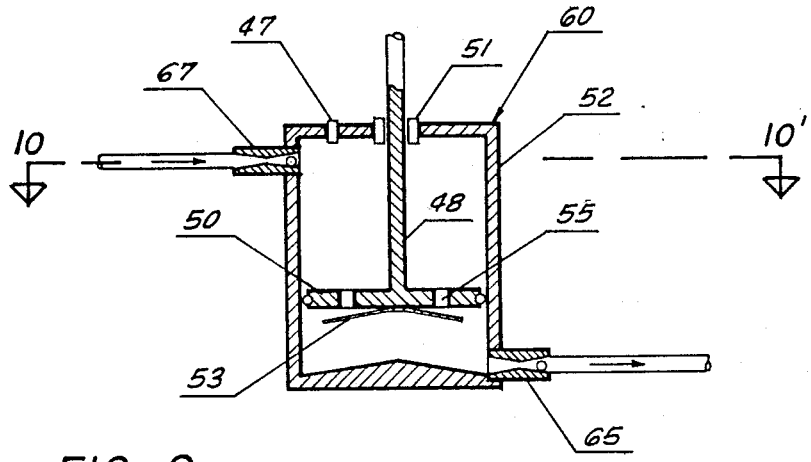
FIG. 9 is an elevational sectional view of a suitable compressor for use in the invention.
Figure 10:
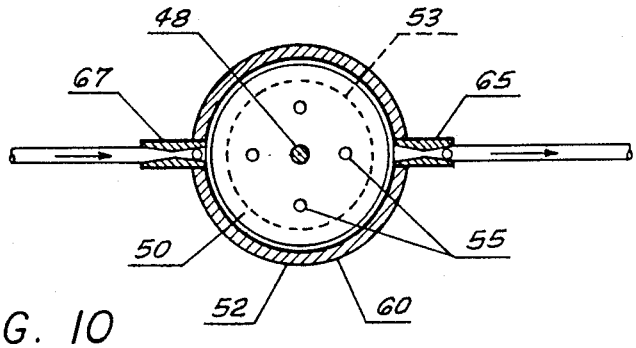
FIG. 10 is a sectional view on line 10—10' of FIG. 9.

The compressor 60 is illustrated in greater detail in FIG. 9 and includes a piston 50 that is mounted on the end of post 48 and reciprocally received in cylinder 52. Post 48 is received through a suitable packing gland 51 in cylinder 52. Piston 50 has a valve, such as a flapper valve 53, which functions with ports 55 to permit free upward movement of piston 50. The cylinder 52 is also provided with the aforementioned check valves 65 and 67 which can be simple check valves such as flapper valves or spring biased ball valves.

The functioning of the heat engine is in accordance with conventional heat engine cycles. A suitable working fluid such as Freon, ammonia, etc., is circulated through the heat engine in a refrigeration and heating cycle. The working fluid is compressed by compressor 60 and is transferred through line as compressed, mixed liquid and gas phases. The working fluid, under compression from compressor 60 condenses into a liquid in the condenser coil 64, releasing its latent heat of evaporation. The condensed working liquid thus releases its latent heat to the inner sole 24, warming the interior of the shoe. The working fluid passes through capillary coil 69 where it expands as it undergoes a frictional pressure drop through the capillary coil 69. The frictional flow pressure drop is sufficient to reduce the pressure of the working fluid and cause evaporation of the liquid, forming a gas phase in the evaporator coil 62. As it evaporates, the working fluid absorbs heat from the surrounding area to provide the necessary latent heat of vaporization of the liquid. The heat is absorbed from the lower layer 56 of the lower sole 28, which is in heat exchange relationship with the external sole 14 of boot 10. The evaporated gas is then transferred through check valve 67 into compressor 60 for continuous circulation in the system.

As can be seen from the preceding description, heat is liberated by the condenser coil 64 and is absorbed by evaporator coil 62.

Figure 11:
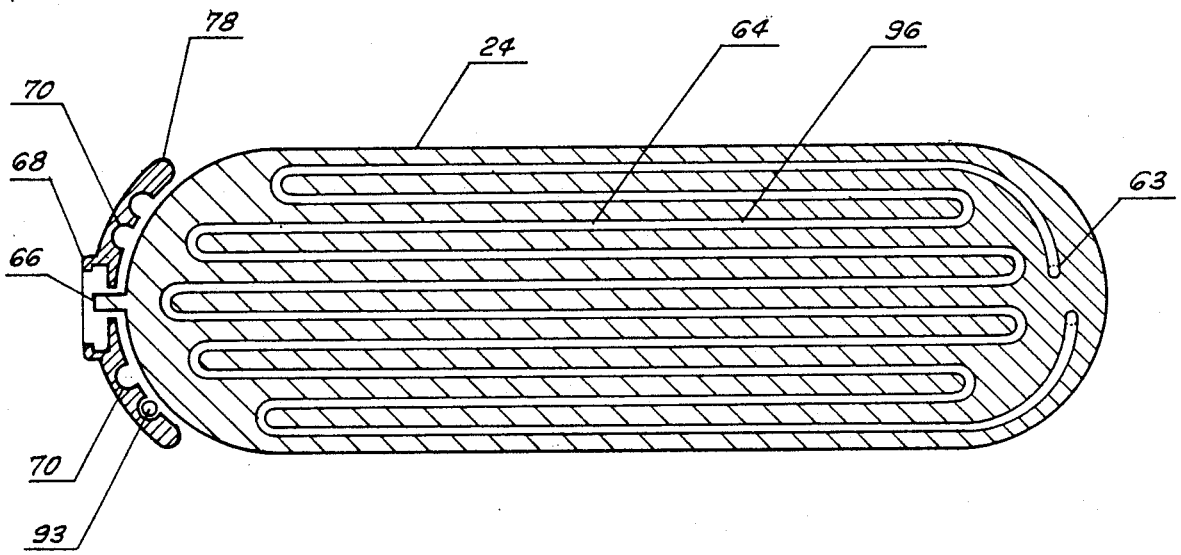
FIG. 11 is a view along line 11—11' of FIG. 1.

The condenser coil 64 is shown in FIG. 11 as a plurality of interconnected parallel tubes 96 which are received within the grooves 94 of the inner sole 24 (see also FIG. 7). The condenser coil receives the compressed, working fluid through tubing 63. The coil discharges the working fluid through an expansion valve 39 (see FIG. 12), which functions similarly to the capillary tube 69, previously described in reference to FIG.

Figure 12:
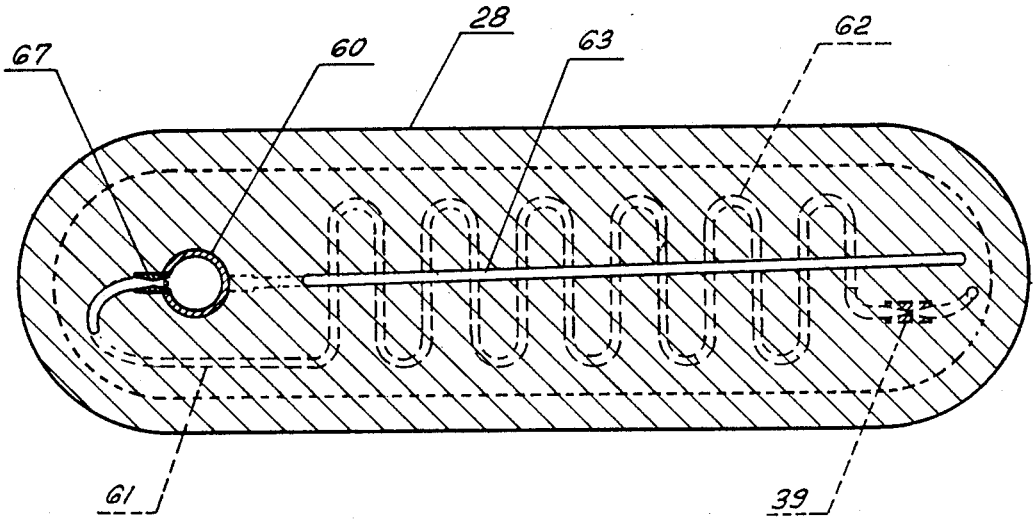
FIG. 12 is a view along line 12—12' of FIG. 1.
Figure 13:
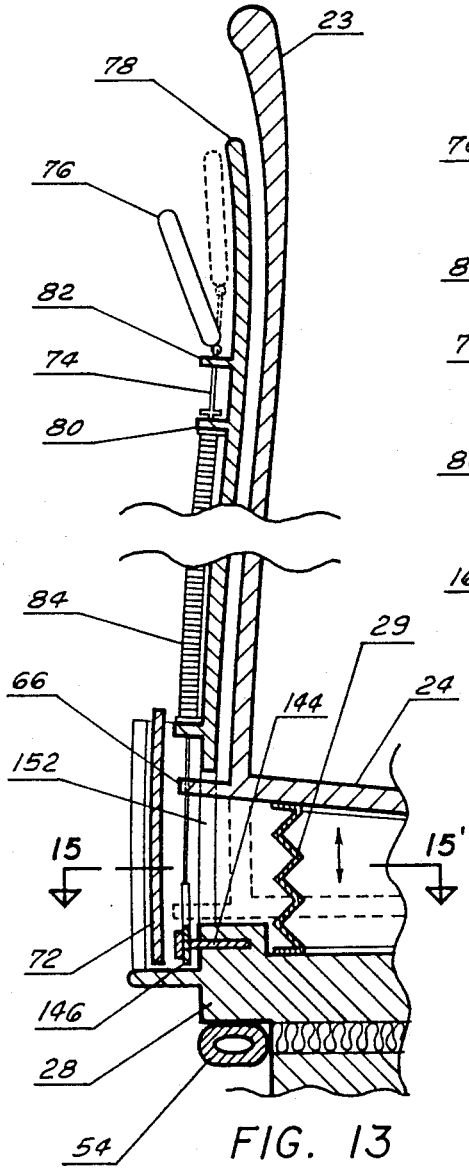
FIG. 13 is an elevational sectional view of the brake mechanism used with the shoe warmer.
Figure 14:
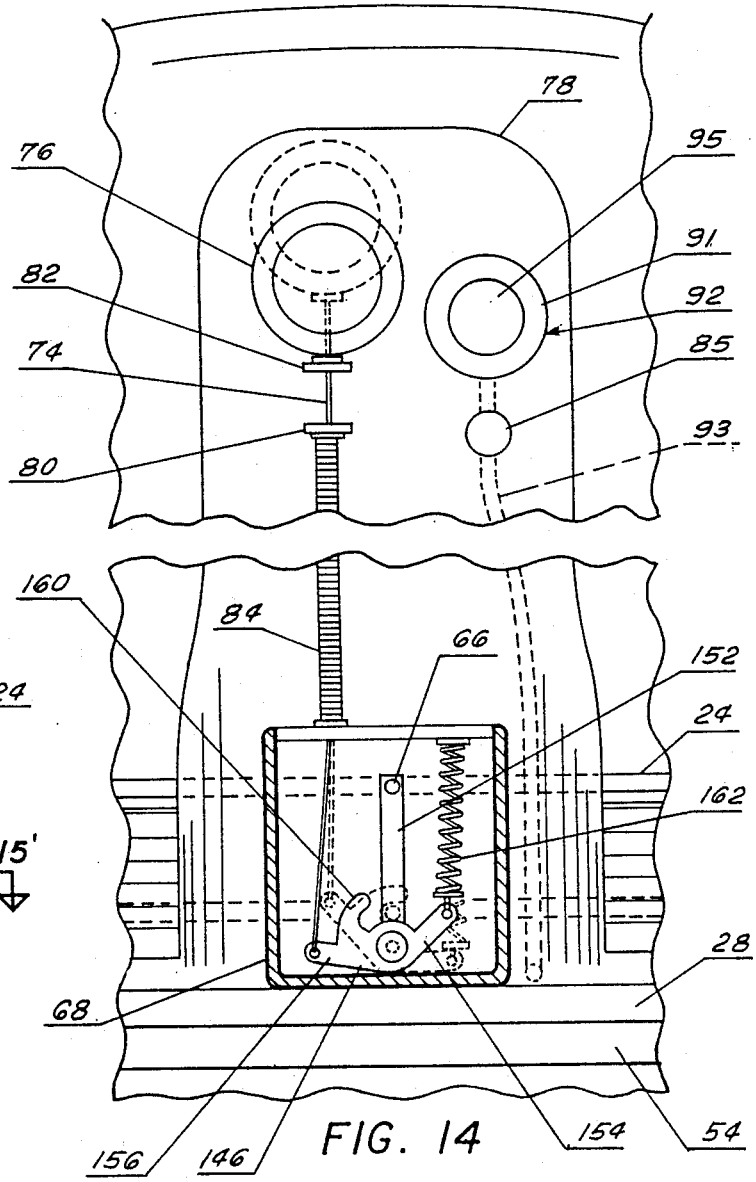
FIG. 14 is a view along line 14—14' of FIG. 15.
Figure 15:
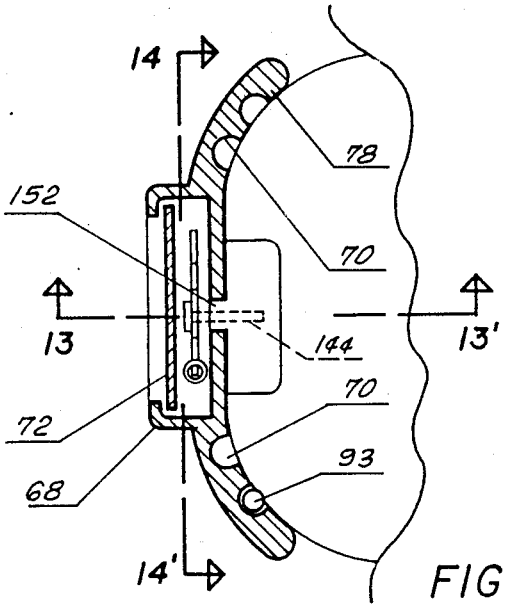
FIG. 15 is a view along line 15—15' of FIG. 13.

8. The evaporator coil 62 receives the depressured working fluid. This coil is shown in FIG. 12 as a continuous serpentine tubing which discharges the evaporated gas through tubing 61 to the compressor 60.

FIG. 11 shows the preferred construction of vertical tab 78. Preferably this tab is formed with a plurality of vertical channels 70 coextensive its length, thereby forming vertical recesses which can receive the tubing 93 for the air system, or flexible conduits such as 84 (shown in FIGS. 1, 2 and 6) and/or flexible conduits 148 and 150 (shown in FIG. 22).

Referring now to FIGS. 13 through 16, the brake mechanism will be described in greater detail. As previously described, the lower sole 28 supports, at its heel end, the vertical tab 78 which has a vertical slot 152 to receive the tab 66 at the end of the inner sole 24. The length of this vertical slot 152 provides the limits of travel for the heel and post 48 (not shown). The brake mechanism includes a latch 146 that is pivotally secured to lock onto the tab 66 on the heel of the inner sole 24. Latch 146 has a spring arm 154 and an actuator arm 156 with a latching finger 160. The spring 162 resiliently biases the mechanism into an unlatched position, which is shown by the solid lines. When the cable 74 is pulled upwardly, the latch finger 160 is rotated into engagement with tab 66, thereby locking the tab 66 and its dependent inner sole 24 in the depressed position, all as shown by the phantom lines in FIGS. 13 and 14.

Figure 16:
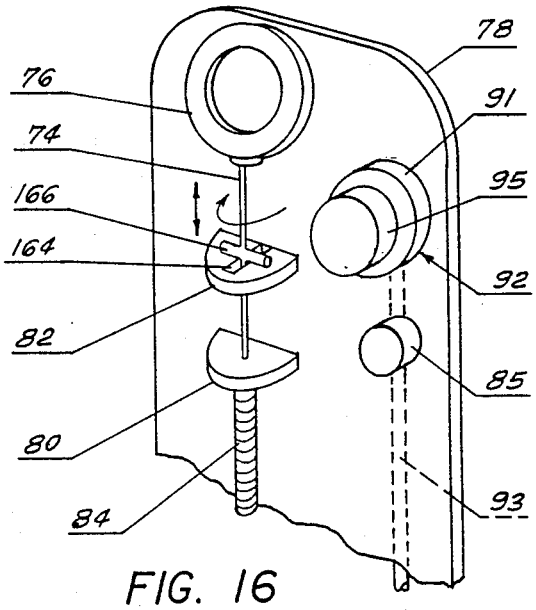
FIG. 16 is a view of the upper end of the rear tab of the inner shoe.

As shown in FIG. 16, the cable 74 extends upwardly through a mounting bracket 80 and a locking bracket 82 which has a single elongated slot 164. A pin 166 is transversely permanently secured to the cable 74 so that when it is pulled through the slot 164 and rotated, as shown in FIG. 16, it will lock the cable 74 against retraction, thereby securing the latch finger 160 in its detenting position against the bias of the spring 162.

Figure 17:
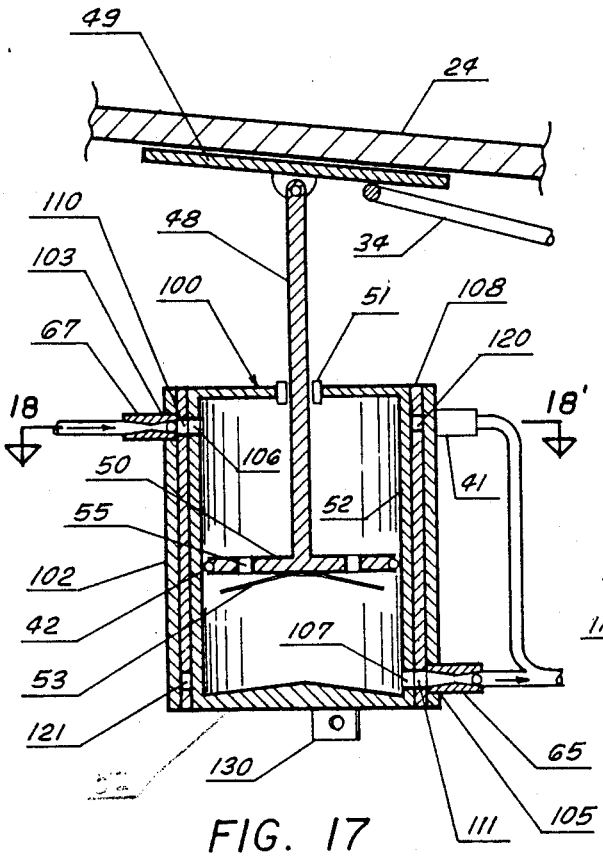
FIG. 17 is an elevational sectional view on line 17—17' of FIG. 18 of an alternative compressor for use in the invention.
Figure 18:
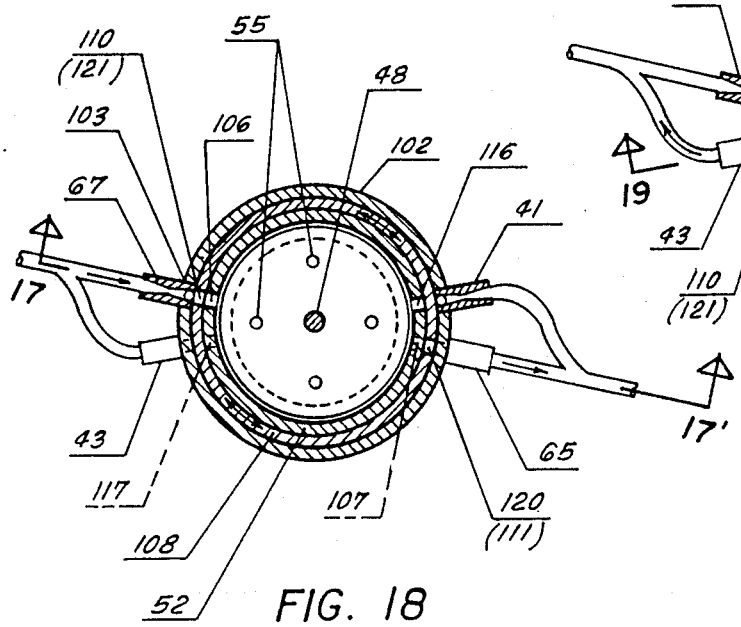
FIG. 18 is a view along line 18—18' of FIG. 17.

Referring now to FIGS. 17 and 18, there is illustrated an alternative compressor for use in the invention. The alternative compressor 100 is formed with an outer cylindrical casing 102 which receives the concentric sleeve 108 and cylinder 52. Cylinder 52 is similar to that previously described and includes an aperture in its top wall with a packing gland 51 that reciprocally receives post 48. Piston 50 is distally carried on post 48 for sliding movement within cylinder 52 and includes seal means such as O-ring 42, and valve 53 previously described. The external cylindrical casing 102 has apertures 103 and 105 which are aligned with the apertures 106 and 107 of cylinder 52. The apertures 103 and 105 receive the check valves 67 and 65, respectively, of the heat engine, all previously described. In this illustrated embodiment, the check valves 67 and 65 are operable to control the fluid flow in the direction indicated by the arrowhead lines.

Sleeve 108 is rotatably received between cylinder 52 and casing 102. The cylinder 52 and casing 102 are stationary. Sleeve 108 has a first set of apertures 110 and 111 and a second set of angularly offset apertures 120 and 121; see also FIGS. 19 and 20. In FIGS. 18 and 20, the upper valves 110 and 120 are in sectional view. The lower apertures 121 and 111 are located below apertures 110 and 120 and are identified by placing these numbers in parenthesis. Apertures 110 and 111 are in open communication with fluid check valves 67 and 65, previously described.

Figure 19:
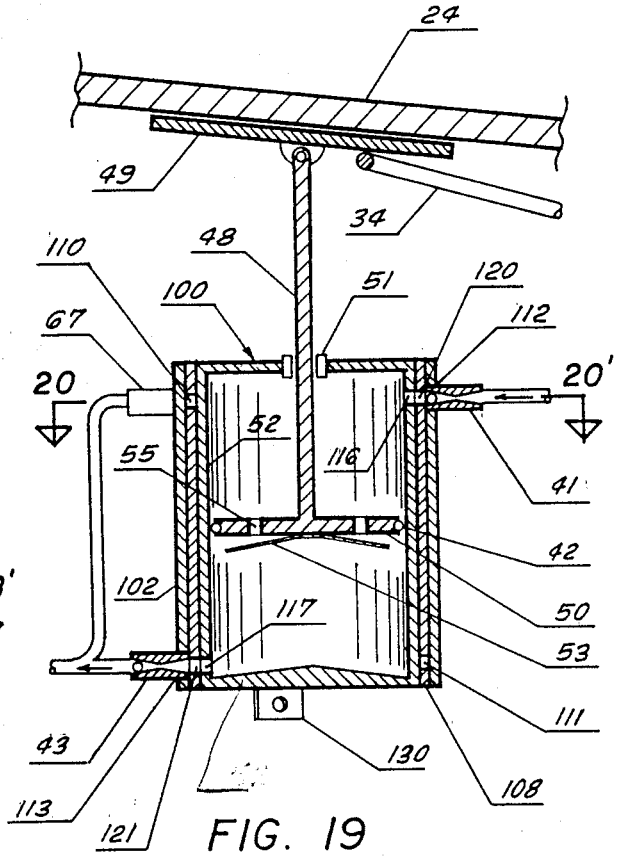
FIG. 19 is an elevational sectional view of the alternative compressor along line 19—19' of FIG. 20 to reverse the cycle of the heat engine.
Figure 20:
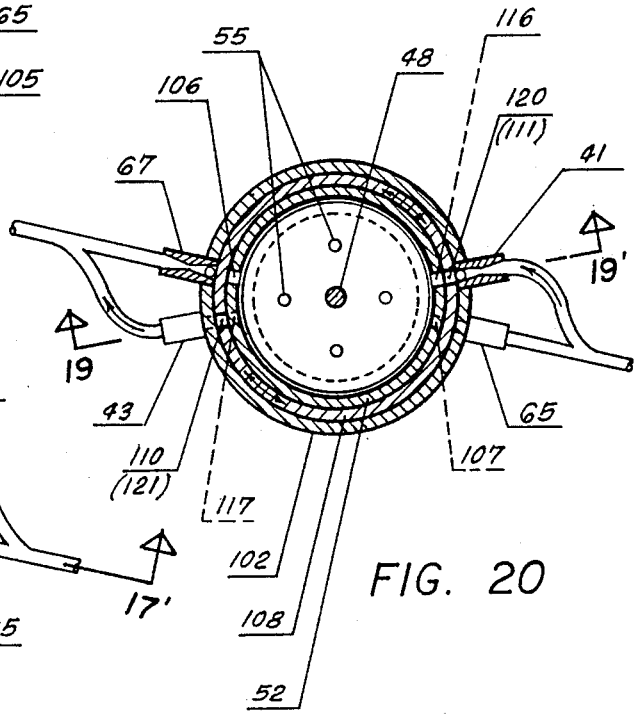
FIG. 20 is a view along line 20—20' of FIG. 19.

Referring to FIGS. 19 and 20, the external cylindrical casing 102 also has apertures 112 and 113 which are aligned with apertures 116 and 117 of cylinder 52. Apertures 112 and 113 receive check valves 41 and 43, respectively, which are oriented in a reverse flow direction from check valves 67 and 65.

In the configuration illustrated in FIGS. 19 and 20, the concentric sleeve 108 has been rotated from its position shown in FIGS. 17 and 18 to align its set of apertures 120 and 121 with apertures 112 and 113 of casing 102 and apertures 116 and 117 of cylinder 52. This will direct flow in the opposite direction from that of FIGS. 17 and 18, all as indicated by the arrowhead lines.

Figure 21:
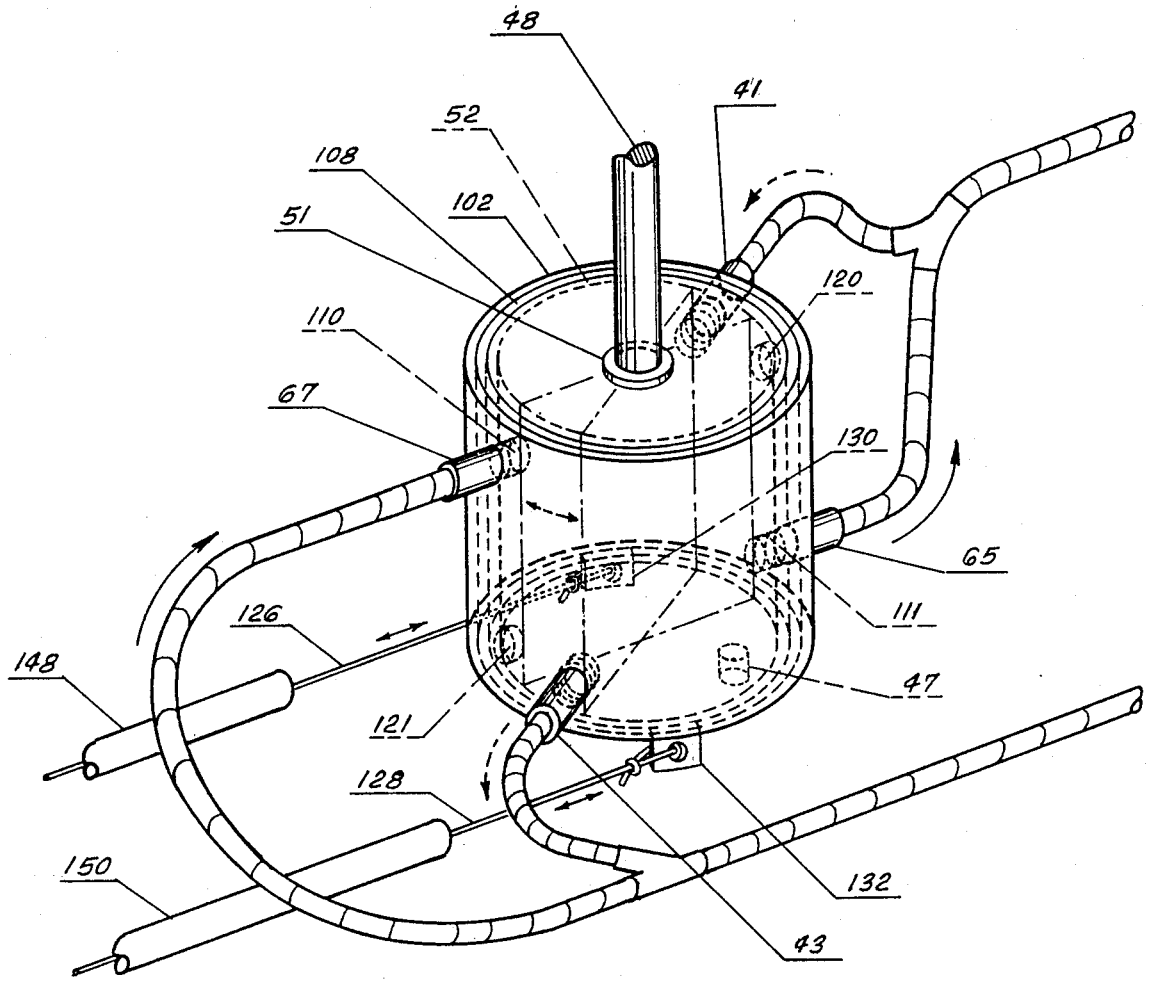
FIG. 21 is a perspective view of the compressor shown in FIGS. 17–20.
Figure 22:
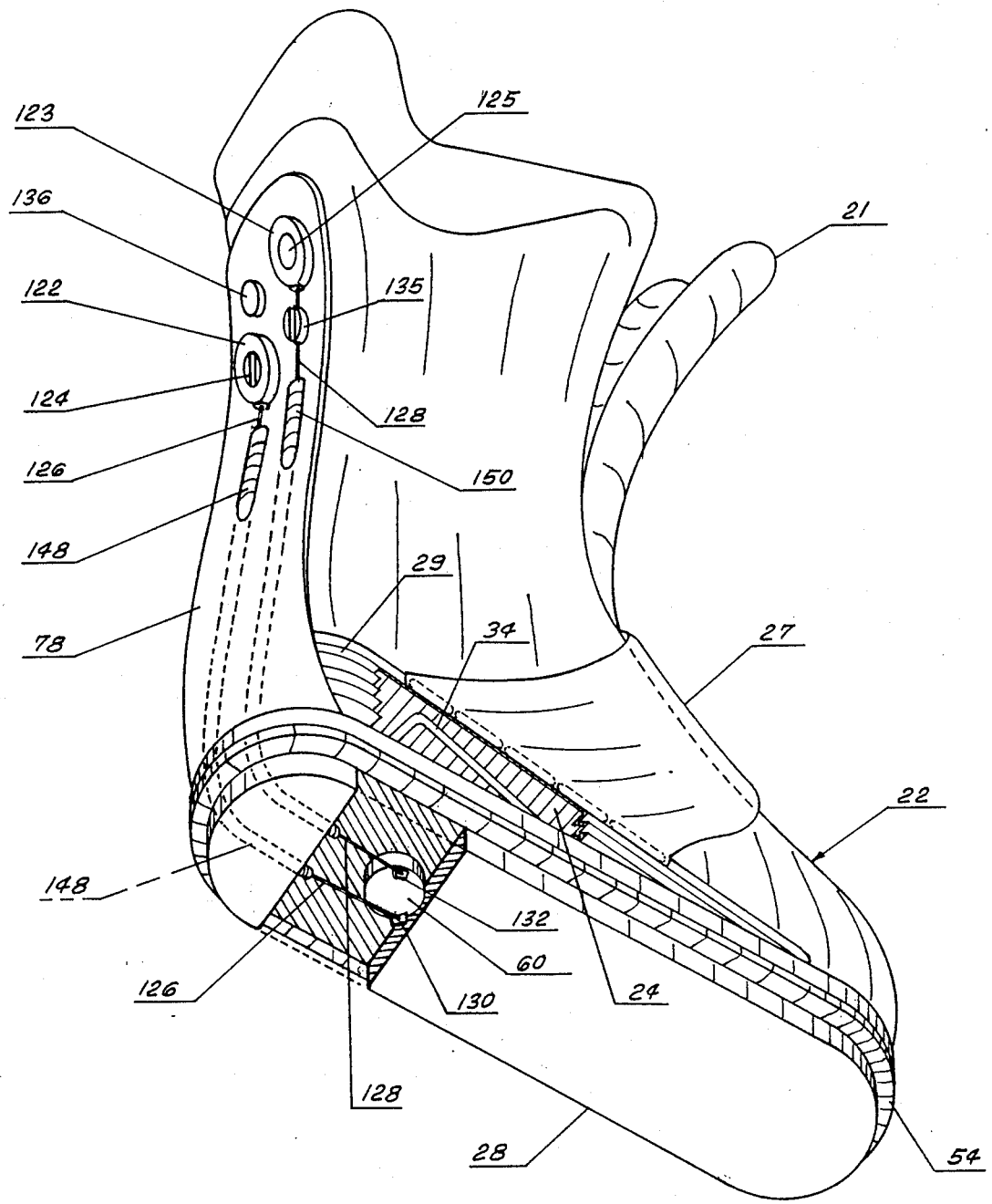
FIG. 22 illustrates the incorporation of the compressor and controls of FIGS. 17–21 in a ski boot.

The alternative compressor is shown in perspective view in FIG. 21. In this illustration, tabs 130 and 132 project downwardly from the rotatable sleeve 108. Cables 126 and 128 are attached to respective tabs 130 and 132. As shown in FIG. 22, the cables extend to the upper end of vertical tab 78 through flexible conduits 148 and 150, where they terminate in pull rings 122 and 123. For purposes of illustration, the pull rings and associated structure is shown without illustration of the air pump 92 and the brake system, which are shown in FIGS. 2 and 6. In actual practice, there is adequate room at the upper end of vertical tab 78 for placing of the pull rings 122 and 123 beside the other structure of the brake cable and ring 76 and the air pump 92.

The cables 126 and 128 can be locked in positions by two pairs of clamp blocks 124 and 136, and 125 and 135. The lowermost clamp block 124 and 135 of each pair of clamp blocks has a narrow slit to receive a cable. The clamp blocks have a diameter to fit within the pull rings, thus permitting locking of the pull ring on its respective upper or lower clamp block. In this manner, remote control of the position of the cylinder 108 in the compressor can be controlled, permitting the wearer to rotate this cylinder, and reverse the heat engine between heating and cooling of the shoes.

The compressor shown in FIGS. 17–20 is thus effective in reversing the operation of the heat engine in the shoe. This permits the shoe to be operated with a heating cycle for warming the wearer's foot and toes during cold weather applications with the coil 64 functioning as the condenser section of the heat engine. When the concentric sleeve 108 is rotated to the position shown in FIGS. 19 and 20, however, the cycle is reversed and the coil 64 then functions as the evaporator portion of the heat engine. This absorbs heat from the interior cavity of the shoe, cooling the wearer's foot and toes during hot weather applications. In this manner, the mechanism can be used for warming or cooling the wearers foot at the discretion of the wearer. During use, the working fluid may need to be recharged to the compressor. This can be accomplished by adding fresh working fluid through port 47. This port can be closed by a conventional valve, not shown.

Figure 23:
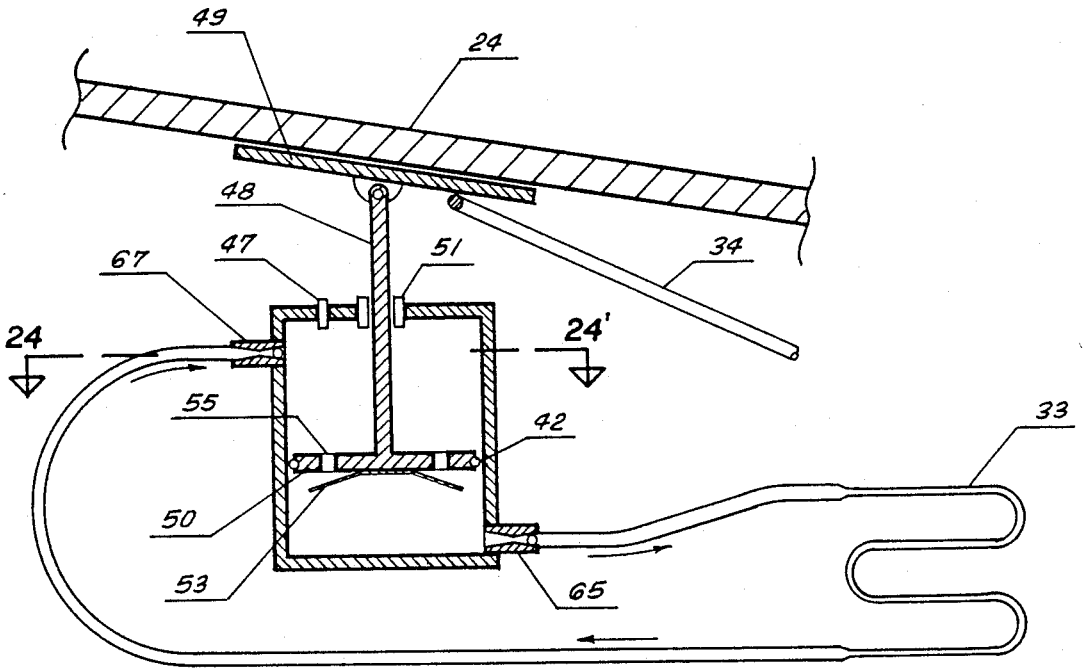
FIG. 23 illustrates an alterative embodiment of the invention.
Figure 24:
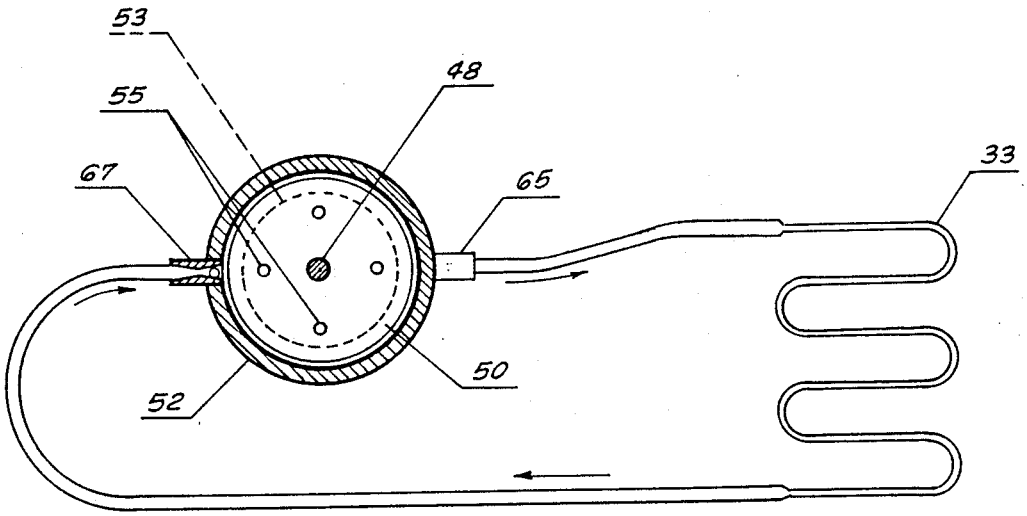
FIG. 24 is a view along line 24—24' of FIG. 23.

Referring now to FIGS. 23 and 24, the invention can also be applied to a simplified fluid circulation system. In this application, the piston 50, post 48, heel plate 49 and spring arm 34 are all as previously described. A working fluid or gas is circulated through the capillary coil 33 under pressure during the downstroke of the piston 50. During this movement, the flapper valve on the undersurface of the piston will close the fluid ports 55 in piston 50. When the wearer's weight is lifted from the heel, spring arm 34 moves the plate 49 upwardly, lifting the piston, and the fluid in the cylinder passes through ports 55 into the chamber beneath the piston. Check valves such as 67 and 65 previously described maintain the pressures and flow direction in the system.

The capillary 33 functions to provide a high fluid pressure drop, thereby generating frictional heat and functioning as a heating unit. These lines could be in the form of a serpentine coil winding such as coil 64, previously described.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a boot of the construction having an outer shell and an inner shoe lining with an inner shoe having an upper portion with an integral inner sole and a contour conforming to the inner shape of said shell, the improvement comprising:

a. a lower sole coextensive with said integral inner sole of said inner shoe and pivotally secured thereto at the toe of said shoe, and having at least a first open-topped compartment of a size and shape to fit within the heel area of said outer shell;

b. resilient lift means biasing the heel of said inner sole in an upward direction;

c. a heat engine operating on a Carnot cycle that includes:

(1) a closed circulation loop having first and second coils separated by a restrictor;

(2) a working fluid within said loop;

(3) a compressor for the working fluid; and d. mechanical means linking said heel of said inner sole to said compressor, whereby up and down movements of said heel are operative to compress said working fluid and circulate it through said closed loop releasing heat in said first coil and absorbing heat in said second coil.

2. The improvement of claim 1 wherein said boot is a ski boot with a molded plastic outer shell and a molded inner shoe.

3. The improvement of claim 1 wherein said inner shoe closely fits into said shell, and said first and second coils are mounted, respectively, in said inner sole and said lower sole, and including a thermally insulating layer therebetween.

4. The improvement of claim 3 wherein said inner sole has a plurality of surface grooves and wherein said first coil is received within said grooves.

5. The improvement of claim 3 including a flexible seal extending entirely about the periphery of said lower sole and operative to resilient engage and seal against the inside wall of said boot.

6. The improvement of claim 1 wherein said compressor has its discharge port communicating with said first coil and its intake port communicating with said second coil, thereby serving to supply heat interiorly of said inner shoe.

7. The improvement of claim 1 wherein said compressor has its discharge port communicating with said second coil and its intake port communicating with said first coil, thereby serving to remove heat from the interior of said inner shoe.

8. The improvement of claim 7 including means to switch said compressor ports between said first and second coils, thereby reversing the flow through said coils, and reversing said heat engine between operations of cooling and heating the interior of said inner shoe.

9. The improvement of claim 8 including cable means extending from said reversal means to a remote location, exterior of said inner shoe.

10. The improvement of claim 1 wherein said first fluid coil is in the inner sole of said inner shoe.

11. The improvement of claim 10 wherein said compressor has two sets of pairs of inlet and outlet check valves in reversed flow direction, and including means to switch said compressor inlet and outlet ports between said first and second sets of paired check valves, thereby reversing the heating and cooling cycles of said heat engine.

12. The improvement of claim 1 wherein said resilient lift means includes spring means located between said inner and lower soles and having a spring arm positioned beneath the heel of said inner sole.

13. The improvement of claim 12 wherein said spring means includes a second spring arm positioned beneath the mid-portion of said inner sole.

14. The improvement of claim 1 including brake means to restrain the movement of said inner sole.

15. The improvement of claim 14 wherein said brake means includes a cam lever pivotally mounted in the heel of the shoe.

16. The improvement of claim 15 wherein said cam lever is operative to move into a position obstructing the upward movement of said inner sole.

17. The improvement of claim 16 wherein said cam lever is covered with a protective rubber covering.

18. The improvement of claim 1 including a flexible liner within the shoe and covering said inner sole.

19. The improvement of claim 1 including an air bag extending about and over the instep area of said inner shoe.

20. The improvement of claim 19 including means secured between said inner and lower soles of said inner shoe, thereby forming a sealed cavity between said soles.

21. The improvement of claim 20 wherein said air bag extends into a sealed communication with said sealed cavity.

22. The improvement of claim 21 wherein said lower sole supports a vertical tab at its heel which extends upwardly to the top of said shell.

23. The improvement of claim 22 including air pump means mounted on the upper end of said vertical tab with an air hose communicating from said air pump to said sealed cavity.

24. The improvement of claim 20 wherein said means is a flexible membrane which extends between the peripheral edges of said inner and lower soles of said inner shoe.

25. The improvement of claim 1 wherein said lower sole supports a vertical tab at its heel and including a brake compartment in the lower end of said vertical tab.

* * * * *